US008816954B2

(12) United States Patent
Shin et al.

(10) Patent No.: US 8,816,954 B2
(45) Date of Patent: Aug. 26, 2014

(54) DISPLAY APPARATUS

(75) Inventors: Ho-Sik Shin, Anyang-si (KR); Gicherl Kim, Asan-si (KR); Joo Woan Cho, Asan-si (KR); Dae-Seop Kim, Suwon-si (KR); Young-Min Park, Seoul (KR)

(73) Assignee: Samsung Display Co., Ltd (KR)

( * ) Notice: Subject to any disclaimer, the term of this patent is extended or adjusted under 35 U.S.C. 154(b) by 1220 days.

(21) Appl. No.: 12/712,150

(22) Filed: Feb. 24, 2010

(65) Prior Publication Data

US 2010/0295876 A1 Nov. 25, 2010

(30) Foreign Application Priority Data

May 25, 2009 (KR) ..... 10-2009-0045581

(51) Int. Cl.
*G09G 5/02* (2006.01)

(52) U.S. Cl.
USPC ..... 345/102; 345/204; 345/211; 345/690; 345/89; 349/61; 362/97.1; 362/97.2

(58) Field of Classification Search
CPC ..... G09G 3/3406; G09G 3/3696; G09G 2320/0626; H05B 33/0827; H05B 33/0815
USPC ..... 345/690, 102, 698, 76–77, 82–83, 345/69–71, 204; 349/69–71; 362/97.1–97.4
See application file for complete search history.

(56) References Cited

U.S. PATENT DOCUMENTS

| | | | | |
|---|---|---|---|---|
| 7,176,878 | B2 * | 2/2007 | Lew et al. | 345/102 |
| 8,077,139 | B2 * | 12/2011 | Chang et al. | 345/102 |
| 8,330,686 | B2 * | 12/2012 | Shin | 345/87 |
| 2004/0145584 | A1 * | 7/2004 | Lee et al. | 345/212 |
| 2006/0214904 | A1 * | 9/2006 | Kimura et al. | 345/102 |
| 2008/0074058 | A1 * | 3/2008 | Lee et al. | 315/291 |
| 2008/0088550 | A1 * | 4/2008 | Kim et al. | 345/82 |
| 2009/0122003 | A1 * | 5/2009 | Chen et al. | 345/102 |

FOREIGN PATENT DOCUMENTS

| | | |
|---|---|---|
| JP | 2005-080394 | 3/2005 |
| JP | 2007-298549 | 11/2007 |
| KR | 10-2008-0034602 A | 4/2008 |

* cited by examiner

*Primary Examiner* — Lun-Yi Lao
*Assistant Examiner* — Olga Merkoulova
(74) *Attorney, Agent, or Firm* — Innovation Counsel LLP

(57) ABSTRACT

In a display apparatus according to one or more embodiments, a boosting circuit boosts an input voltage to a backlight driving voltage, and a backlight unit receives the backlight driving voltage to generate light. A backlight driving circuit controls the boosting circuit in response to a dimming signal and compensates a plurality of feedback voltages from the backlight unit to output a panel driving voltage. A panel driving circuit receives the panel driving voltage from the backlight driving circuit to output a data voltage corresponding to an image signal and receives a gate driving voltage to generate a gate voltage. A display panel displays an image in response to the gate voltage and the data voltage. Accordingly, a number of the boosting circuits for the display apparatus may decrease, thereby reducing a manufacturing cost of the display apparatus.

19 Claims, 4 Drawing Sheets

DISPLAY APPARATUS

CROSS-REFERENCE TO RELATED APPLICATION

This application relies for priority upon Korean Patent Application No. 2009-45581 filed on May 25, 2009, the contents of which are herein incorporated by reference in their entirety.

BACKGROUND

1. Technical Field

Embodiments of the present invention generally relate to a display apparatus. More particularly, embodiments of the present invention relate to a display apparatus including a light emitting diode as a backlight unit thereof.

2. Description of the Related Art

A liquid crystal display includes a liquid crystal display panel displaying an image and a backlight unit disposed under the liquid crystal display panel to provide light to the liquid crystal display panel. In general, a cold cathode fluorescent lamp is used as the backlight unit.

However, an environmentally-friendly light emitting diode that has low power consumption and superior color reproducibility is spotlighted as a light source for a next-generation backlight unit due to high oil prices.

In case that the light emitting diode is employed as a light source for a backlight unit, the backlight unit includes a plurality of light emitting groups connected to each other in parallel, and each group includes a plurality of light emitting diodes connected to each other in series.

In general, the liquid crystal display, employing the light emitting diode as the light source for the backlight unit, includes a DC-DC converter that applies a driving voltage to a driving circuit for a liquid crystal display panel and a DC-DC converter that applies a driving voltage to the backlight unit.

SUMMARY

Embodiments of the present invention provide a display apparatus capable of reducing the number of DC-DC converters for a backlight unit that employs a light emitting diode as a light source for a backlight unit.

In one embodiment of the present invention, a display apparatus includes a boosting circuit, a backlight unit, a backlight driving circuit, a panel driving circuit, and a display panel.

The boosting circuit boosts an input voltage to a backlight driving voltage, and the backlight unit receives the backlight driving voltage to generate a light. The backlight driving circuit controls the boosting circuit in response to a dimming signal. The panel driving circuit receives a voltage feedback from the backlight unit to generate a gray-scale voltage, outputs a data voltage corresponding to an image signal based on the gray-scale voltage, and receives a gate driving voltage to generate a gate voltage. The display panel displays an image in response to the gate voltage and the data voltage.

According to the above, since the feedback voltage from the backlight unit is applied to the driving circuit (e.g. data driver) for the liquid crystal display after compensated by the backlight driving circuit, a DC-DC converter that applies the driving voltage to the driving circuit may be removed from the liquid crystal display. Thus, the number of parts for the liquid crystal display may decrease, thereby reducing manufacturing cost of the liquid crystal display.

BRIEF DESCRIPTION OF THE DRAWINGS

The above and other advantages of the embodiments of the present invention will become readily apparent by reference to the following detailed description when considered in conjunction with the accompanying drawings wherein.

DETAILED DESCRIPTION

Figure 1:
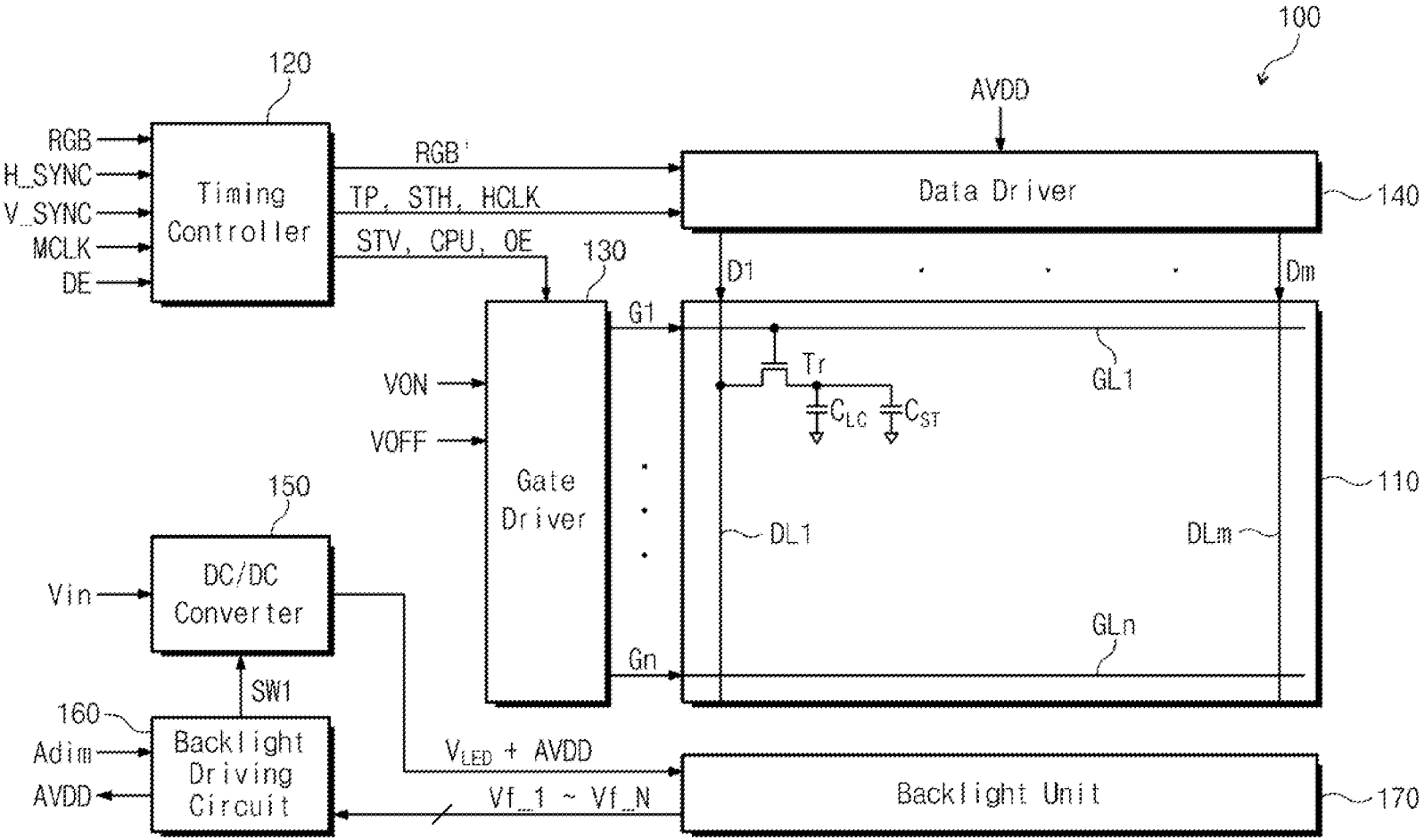
FIG. 1 is a block diagram showing a liquid crystal display according to an embodiment of the present invention.

It will be understood that when an element or layer is referred to as being "on", "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be explained in detail with reference to the accompanying drawings.

FIG. 1 is a block diagram showing a liquid crystal display according to an embodiment of the present invention.

Referring to FIG. 1, a liquid crystal display 100 includes a liquid crystal display panel 110, a timing controller 120, a gate driver 130, a data driver 140, a direct current to direct current (DC-DC) converter 150, a backlight driving circuit 160, and a backlight unit 170.

The liquid crystal display panel 110 includes a plurality of gate lines GL1~GLn, a plurality of data lines DL1~DLm crossing the gate lines GL1~GLn, and a plurality of pixels arranged in regions (e.g., pixel regions) in one-to-one correspondence. For the convenience of explanation, one pixel has been shown in FIG. 1. Each pixel includes a thin film transistor Tr connected to a corresponding gate line of the gate lines GL1~GLn through a gate electrode thereof and a corresponding data line of the data lines DL1~DLm through a source electrode thereof, a liquid crystal capacitor $C_{LC}$ connected to a drain electrode of the thin film transistor Tr, and a storage capacitor $C_{ST}$ connected to the drain electrode of the thin film transistor Tr.

The timing controller 120 receives various signals from an external device, such as an image data signal RGB, a horizontal synchronizing signal H_SYNC, a vertical synchronizing signal V_SYNC, a clock signal MCLK, and a data enable signal DE. The timing controller 120 converts data formats of the image data signal RGB into data formats suitable for an interface between the timing controller 120 and the data driver 140 and outputs the converted image data signal RGB' to the data driver 140. In addition, the timing controller 120 outputs data control signals, such as an output start signal TP, a horizontal start signal STH, and a clock signal HCLK, to the data driver 140, and outputs gate control signals, such as a vertical start signal STV, a gate clock signal CPU, and an output enable signal OE, to the gate driver 130.

The gate driver 130 receives a gate-on voltage Von and a gate-off voltage Voff and sequentially outputs gate signals G1~Gn having the gate-on voltage Von in response to the gate control signals STV, CPU, and OE applied from the timing controller 120. The gate signals G1~Gn are sequentially applied to the gate lines GL1~GLn of the liquid crystal display panel 110 to sequentially scan the gate lines GL1~GLn. Although not shown in FIG. 1, the liquid crystal display 100 may further include a regulator that converts an input voltage into the gate-on voltage Von and the gate-off voltage Voff. In this case, the regulator may receive a voltage different from an input voltage Vin applied to the DC-DC converter 150.

The data driver 140 may be driven in response to an analog driving voltage AVDD to generate gray-scale voltages by using gamma voltages applied from a gamma voltage generator (not shown). Responsive to the data control signals TP, STH, and HCLK from the timing controller 120, the data driver 140 selects gray-scale voltages corresponding to the image data signal RGB' among the gray-scale voltages and applies the selected gray-scale voltages to the data lines DL1~DLm of the liquid crystal display panel 110 as data signals D1~Dm.

When the gate signals G1~Gn are sequentially applied to the gate lines GL1~GLn, the data signals D1~Dm are applied to the data lines DL1~DLm. Particularly, when a gate signal is applied to a selected gate line, a thin film transistor Tr connected to the selected gate line is turned on in response to the gate signal. Then, when a data signal is applied to the data line connected to the turn-on thin film transistor Tr, the applied data signal is charged into the liquid crystal capacitor $C_{LC}$ and the storage capacitor $C_{ST}$ through the turn-on thin film transistor Tr.

The liquid crystal capacitor $C_{LC}$ controls light transmittance of liquid crystal molecules according to the charged voltage. The storage capacitor $C_{ST}$ stores the data signal therein while the thin film transistor Tr is turned on and applies the stored data signal to the liquid crystal capacitor $C_{LC}$ while the thin film transistor Tr is turned off to sustain the voltage charged in the liquid crystal capacitor $C_{LC}$. Thus, the liquid crystal display panel 110 may display images.

The backlight unit 170 is positioned at a rear side of the liquid crystal display panel 110 and provides light to the liquid crystal display panel 110 in response to a backlight driving voltage $V_{LED}$+AVDD from the DC-DC converter 150. The DC-DC converter 150 boosts the input voltage Vin to the backlight driving voltage $V_{LED}$+AVDD and applies the backlight driving voltage $V_{LED}$+AVDD to the backlight unit 170. The backlight driving circuit 160 controls the DC-DC converter 150 in response to an analog dimming signal Adim and compensates a plurality of feedback voltages Vf_1~Vf_N from the backlight unit 170. The compensated voltages are output from the backlight driving circuit 160 as the analog driving voltage AVDD.

As shown in FIG. 1, the analog driving voltage AVDD may be applied to the data driver 140 to drive the data driver 140. Although not shown in FIG. 1, the analog driving voltage AVDD may be applied to the gamma voltage generator that generates the gamma voltages.

Figure 2:
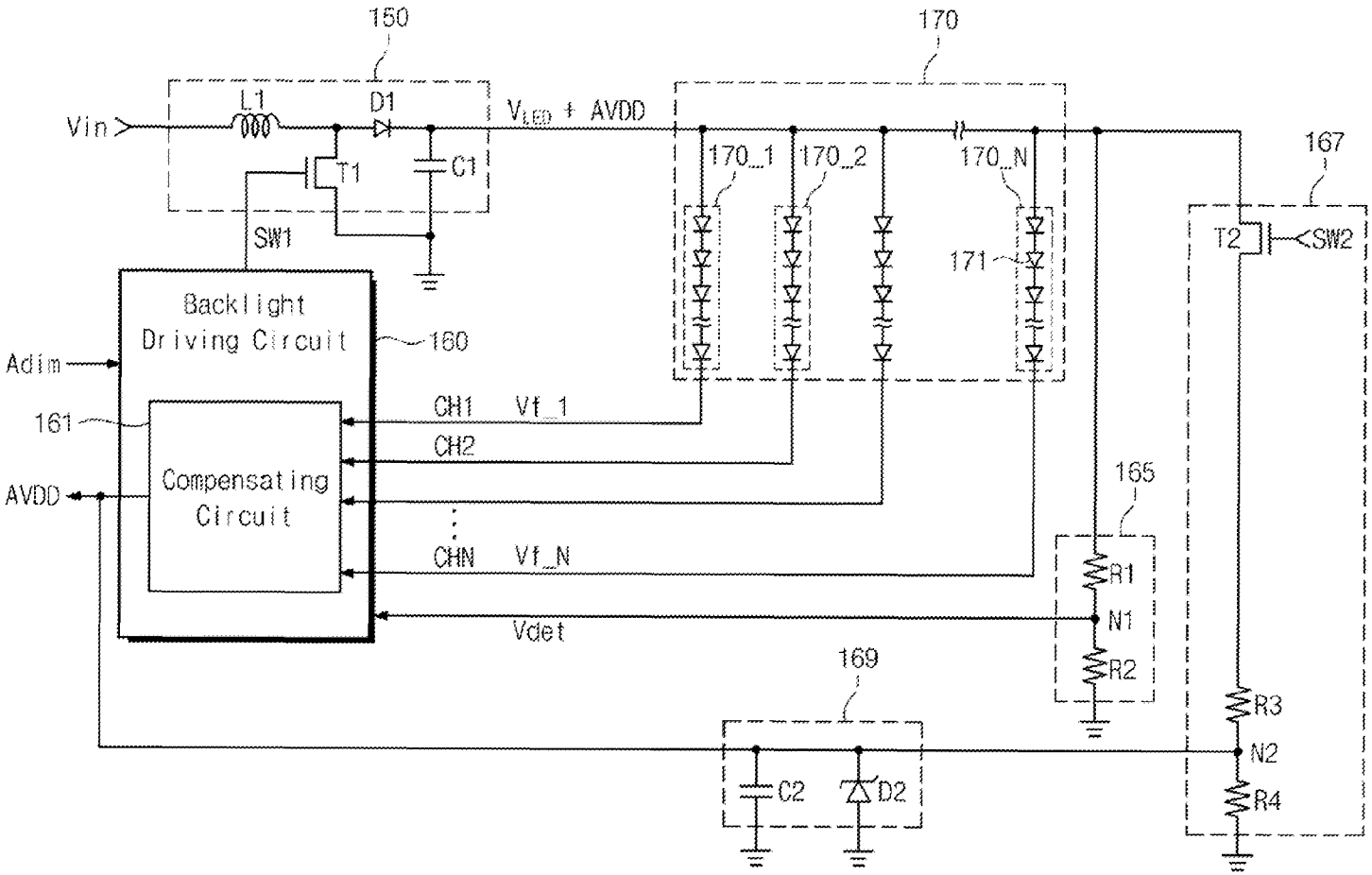
FIG. 2 is a circuit diagram of a DC-DC converter, a backlight driving circuit, and a backlight unit shown in FIG. 1 according to an embodiment.

FIG. 2 is a circuit diagram of a DC-DC converter, a backlight driving circuit, and a backlight unit shown in FIG. 1 according to an embodiment.

Referring to FIG. 2, the backlight unit 170 includes a plurality of light-emitting groups 170_1~170_N that are connected to each other in parallel, and each of the light-emitting groups 170_1~170_N includes a plurality of light emitting diodes 171 that are connected to each other in series.

The DC-DC converter 150 boosts the input voltage Vin (e.g., 12 volts) to output the backlight driving voltage $V_{LED}$+AVDD. The backlight driving voltage $V_{LED}$+AVDD may have a voltage level corresponding to the sum of the LED driving voltage $V_{LED}$ (e.g., 20 volts to 35 volts) for the light-emitting groups 170_1~170_N of the backlight unit 170 and the analog driving voltage AVDD (e.g., 8 volts to 9 volts) applied to the data driver 140.

In particular, the DC-DC converter 150 may include a coil L1, a diode D1, a first capacitor C1, and a first transistor T1. The first transistor T1 receives a first switching signal SW1 through a control terminal thereof connected to the backlight driving circuit 160.

The backlight driving circuit 160 receives the analog dimming signal Adim and outputs the first switching signal SW1 based on the analog dimming signal Adim to control the DC-DC converter 150. As an example according to an embodiment of the present invention, the analog dimming signal Adim may be used to control a size of the driving current from the backlight unit 170. Accordingly, the DC-DC converter 150 may control the voltage level of the backlight driving voltage $V_{LED}$+AVDD in response to the first switching signal SW1.

In FIG. 2, a circuit configuration wherein the analog dimming signal Adim is applied to the backlight driving circuit 160 has been shown according to an embodiment. However, as another example according to an embodiment of the present invention, the backlight driving circuit 160 may receive a pulse width modulation (PWM) dimming signal and include a circuit therein to convert the PWM dimming signal into the analog dimming signal Adim. The PWM dimming signal may be used to adjust a duty ratio of the backlight driving voltage $V_{LED}$+AVDD. That is, the backlight driving circuit 160 may convert the PWM dimming signal into the analog dimming signal Adim that is capable of controlling the voltage level of the backlight driving voltage $V_{LED}$+AVDD by using the circuit thereof.

In addition, the backlight driving circuit 160 may be formed in one chip and include a plurality of channels CH1~CHN connected to the light-emitting groups 170_1~170_N in one-to-one correspondence. Thus, the backlight driving circuit 160 receives the feedback voltages Vf_1~Vf_N through the channels CH1~CHN.

The backlight driving circuit 160 may further include a compensating circuit 161 connected to the channels CH1~CHN to compensate differences between the feedback voltages Vf_1~Vf_N. That is, the driving current set by the analog dimming signal Adim of the backlight driving circuit 160 is uniformly applied to the light-emitting groups 170_1~170_N. However, the feedback voltages Vf_1~Vf_N from the light-emitting groups 170_1~170_N may have different values from each other according to properties of LEDs. The compensating circuit 161 has been prepared to compensate the differences between the feedback voltages Vf_1~Vf_N.

Although not shown in FIG. 2, the compensating circuit 161 may include a plurality of switching devices connected to the channels CH1~CHN in one-to-one correspondence and a plurality of resistors connected to output terminals of the switching devices in one-to-one correspondence. The switching devices and the resistors may limit the current flowing through a corresponding light-emitting group of the light-emitting groups, thereby compensating the differences between the feedback voltages Vf_1~Vf_N. The voltage compensated by the compensating circuit 161 is applied to the data driver 140 as the analog driving voltage AVDD.

In addition, the backlight driving circuit 160 may compare the feedback voltages Vf_1~Vf_N with a predetermined reference voltage. According to the compared result, the backlight driving circuit 160 controls the DC-DC converter 150 to vary the backlight driving voltage $V_{LED}$+AVDD. The reference voltage may have the voltage level (e.g., 8 volts to 9 volts) of the analog driving voltage AVDD required from the data driver 140. Thus, if a feedback voltage having a lowest voltage level among the feedback voltages Vf_1~Vf_N is lower than the reference voltage, the DC-DC converter 150 may boost the backlight driving voltage $V_{LED}$+AVDD until the feedback voltage has the voltage level of the analog driving voltage AVDD.

As an example according to an embodiment of the present invention, the liquid crystal display 100 may further include a detection circuit 165 that includes first and second resistors R1 and R2 connected to an input of the backlight unit 170 to receive the backlight driving voltage $V_{LED}$+AVDD. The detection circuit 165 applies a voltage Vdet, which is detected at a coupling node N1 between the first and second resistors R1 and R2, to the backlight driving circuit 160.

The backlight driving circuit 160 compares the detected voltage Vdet with a predetermined reference voltage and controls the DC-DC converter 150 according to the compared result, so that the backlight driving circuit 160 may vary the backlight driving voltage $V_{LED}$+AVDD. The reference voltage may have the voltage level (e.g., 8 volts to 9 volts) of the analog driving voltage AVDD required from the data driver 140. Thus, when the detected voltage Vdet is smaller than the reference voltage, the DC-DC converter 150 may boost the backlight driving voltage $V_{LED}$+AVDD until the detected voltage Vdet has the voltage level of the analog driving voltage AVDD.

In addition, the liquid crystal display 100 may further include a connection circuit 167 that is provided between the input of the backlight unit 170 and the output of the backlight driving circuit 160, through which the analog driving voltage AVDD is output, to form a current path. The connection circuit 167 may be operated when the size of the driving current input to the backlight unit 170 is smaller than a predetermined reference current, thereby forming the current path. The reference current may be set to have a minimum driving current value at which the feedback voltages Vf_1~Vf_N may have a voltage level corresponding to that of the analog driving voltage AVDD.

The backlight driving circuit 160 may check whether the size of the driving current provided to the backlight unit 170 is smaller than the reference current based on the analog dimming signal Adim. As a result, when the driving current is smaller than the reference current, the backlight driving circuit 160 applies a second switching signal SW2 to drive the connection circuit 167.

As an example according to an embodiment of the present invention, the connection circuit 167 includes a second switching device T2 turned on in response to the second switching signal SW2, a third resistor R3 connected between an output electrode of the second switching device T2 and the output of the backlight driving circuit 160, and a fourth resistor R4 connected between the output of the backlight driving circuit 160 and ground.

When the second switching device T2 is turned on in response to the second switching signal SW2, an electric potential at a coupling node N2 between the third and fourth resistors R3 and R4 is varied by the driving current, and the electric potential may be applied to the data driver 140 as the analog driving voltage AVDD. Thus, although the size of the driving current of the backlight unit 170 becomes smaller than the reference current, the voltage level of the analog driving voltage AVDD may be prevented from being lowered below a minimum voltage level required from the data driver 140.

In addition, the liquid crystal display 100 may further include a stabilization circuit 169 connected to the output of the backlight driving circuit 160, from which the analog driving voltage AVDD is output, to stabilize the analog driving voltage AVDD. The stabilization circuit 169 includes a zener diode D2 that is connected between the output of the backlight driving circuit 160 and ground to uniformly maintain the analog driving voltage AVDD and a second capacitor C2 that is connected in parallel to the zener diode D2 to remove a ripple of the analog driving voltage AVDD.

In the embodiment of FIG. 2, a circuit configuration wherein the DC-DC converter 150 is independently provided from the backlight driving circuit 160 prepared in the chip has been described, however, the DC-DC converter 150 may be built in the chip for the backlight driving circuit 160.

As described above according to one or more embodiments, in case that the feedback voltage compensated by the backlight driving circuit 160 is applied to the data driver 140 as the analog driving voltage AVDD, the liquid crystal display 100 may not need to have any additional DC-DC converters generating the analog driving voltage AVDD and applying the analog driving voltage AVDD to the data driver 140. Accordingly, the number of the DC-DC converters for the liquid crystal display 100 may decrease, thereby reducing manufacturing cost required to manufacture the liquid crystal display 100.

In addition, when the number of the DC-DC converters decreases, a printed board assembly may be reduced in size, on which various parts, such as the DC-DC converter 150, the timing controller 120, etc., are installed.

Figure 3:
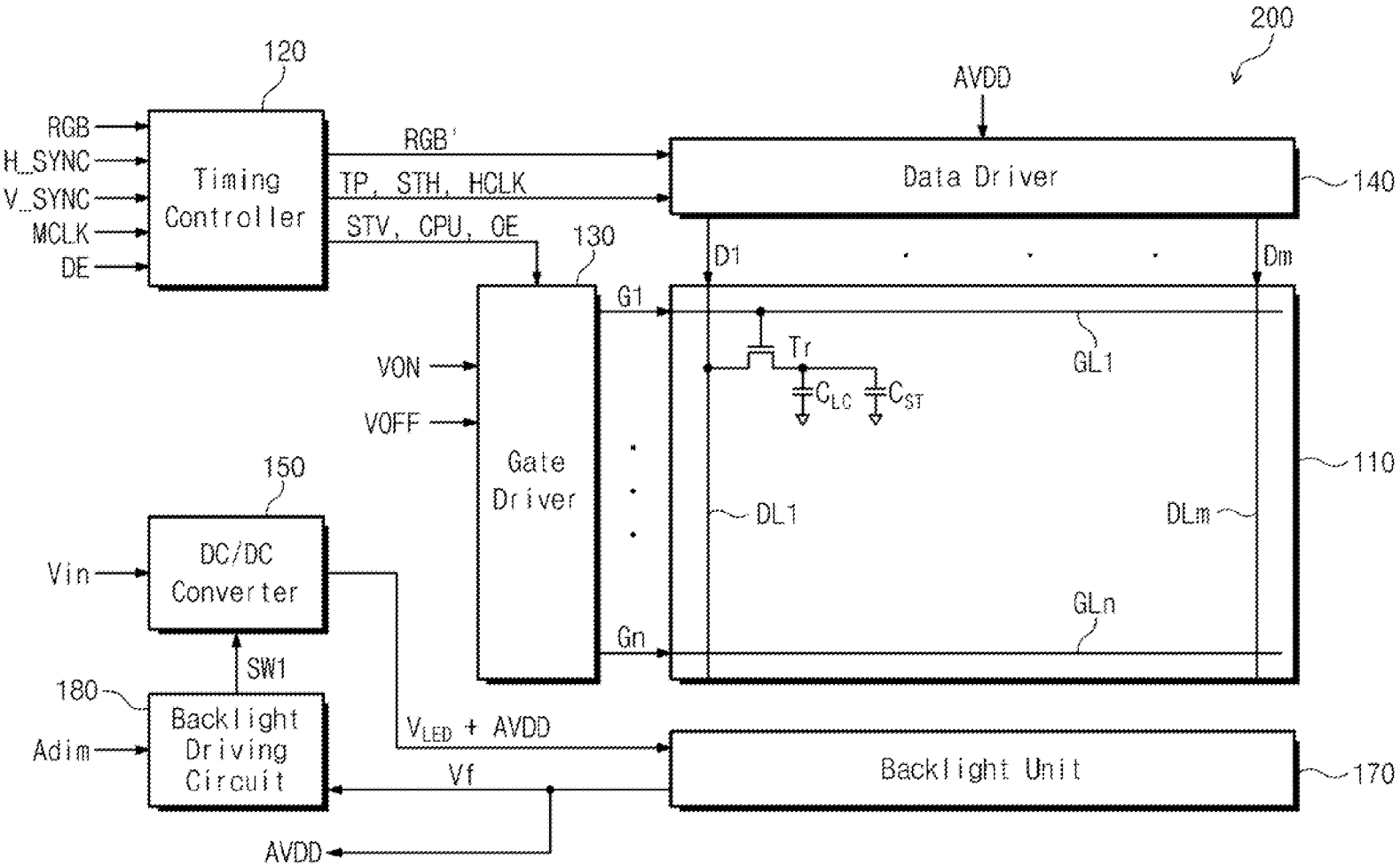
FIG. 3 is a block diagram showing a liquid crystal display according to another embodiment of the present invention.

FIG. 3 is a block diagram showing a liquid crystal display according to another embodiment of the present invention. In FIG. 3, the same reference numerals denote the same elements in FIG. 1, and thus detailed descriptions of the same elements will be omitted.

Referring to FIG. 3, a liquid crystal display 200 includes a liquid crystal display panel 110, a timing controller 120, a gate driver 130, a data driver 140, a DC-DC converter 150, a backlight driving circuit 180, and a backlight unit 170.

The backlight driving circuit 180 controls the DC-DC converter 150 in response to an analog dimming signal Adim and receives a feedback voltage Vf from the backlight unit 170. As an example according to an embodiment of the present invention, the feedback voltage Vf from the backlight unit 170 may be directly applied to the data driver 140 as an analog driving voltage AVDD.

Figure 4:
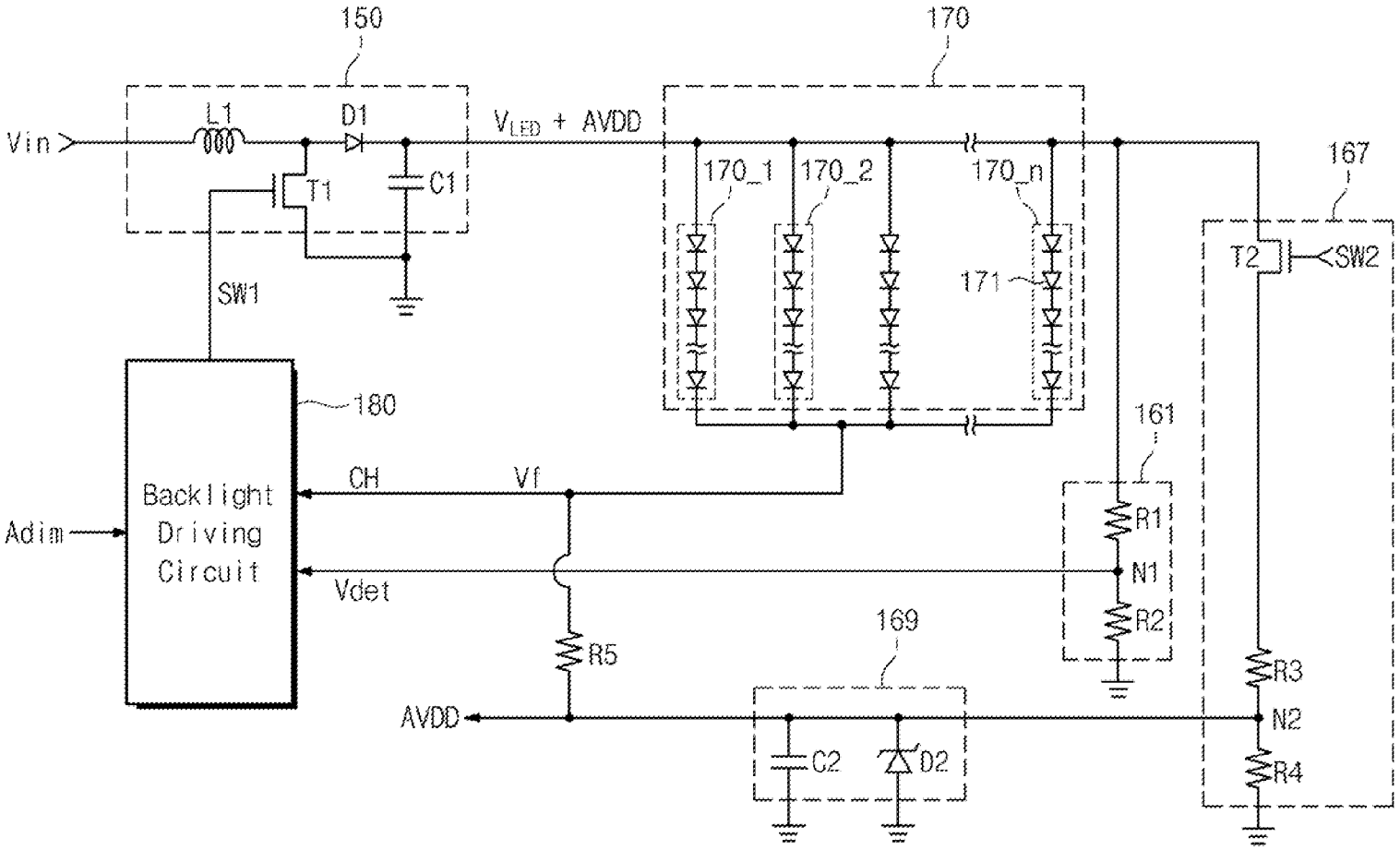
FIG. 4 is a circuit diagram of a DC-DC converter, a backlight driving circuit, and a backlight unit shown in FIG. 3 according to an embodiment.

FIG. 4 is a circuit diagram of a DC-DC converter, a backlight driving circuit, and a backlight unit shown in FIG. 3 according to an embodiment.

Referring to FIG. 4, the backlight unit 170 includes a plurality of light-emitting groups **170_1~170_*n* connected to each other in parallel, and each of the light-emitting groups 170_1~170_*n* includes a plurality of light emitting diodes 171** connected to each other in series.

The backlight driving circuit 180 may be formed in one chip and include one channel CH commonly connected to the light-emitting groups **170_1~170_*n*. Thus, the backlight driving circuit 180 receives the feedback voltage Vf through the channel CH. The feedback voltage Vf is transmitted to the data driver 140** as the analog driving voltage AVDD.

As an example according to an embodiment of the present invention, a fifth resistor R5 may be connected to the channel CH, so that the analog driving voltage AVDD may be varied according to the resistance of the fifth resistor R5.

In the present exemplary embodiment, a detection circuit 161 and a connection circuit 167 shown in FIG. 4 may have the same circuit configurations as those of the detection circuit 165 and the connection circuit 167 shown in the embodiment of FIG. 2, and thus detailed descriptions thereof will be omitted.

As shown in FIG. 4, the liquid crystal display 200 further includes a stabilization circuit 169 connected to an end of the fifth resistor R5 to stabilize the analog driving voltage AVDD. The stabilization circuit 169 includes a zener diode D2 connected between the fifth resistor R5 and ground to uniformly maintain the analog driving voltage AVDD and a second capacitor C2 connected to the zener diode D2 in parallel to remove ripple of the analog driving voltage AVDD.

As described above, in case that the backlight driving circuit 180 includes one channel CH, the feedback voltage Vf from the backlight unit 170 may be directly applied to the data driver 140 without passing through the backlight driving circuit 180. Thus, the liquid crystal display 200 may provide enough margin of the analog driving voltage AVDD.

According to one or more embodiments of the liquid crystal display, since the feedback voltage from the backlight unit is applied to the driving circuit (e.g. data driver) for the liquid crystal display after compensated by the backlight driving circuit, a DC-DC converter that applies the driving voltage to the driving circuit may be removed from the liquid crystal display. Thus, the number of parts for the liquid crystal display may decrease, thereby reducing manufacturing cost of the liquid crystal display.

Although exemplary embodiments of the present invention have been described, it is understood that the present disclosure should not be limited to these exemplary embodiments but various changes and modifications may be made by one ordinary skilled in the art within the spirit and scope of the present disclosure as hereinafter claimed.

What is claimed is:

1. A display apparatus comprising:

a boosting circuit adapted to boost an input voltage to a backlight driving voltage;

a backlight unit adapted to receive the backlight driving voltage to generate a light;

a backlight driving circuit adapted to control the boosting circuit in response to a dimming signal and to compensate a plurality of feedback voltages from the backlight unit to output a panel driving voltage;

a panel driving circuit adapted to receive the panel driving voltage from the backlight driving circuit to output a data voltage corresponding to an image signal and receive a gate driving voltage to generate a gate voltage; and a display panel adapted to display an image in response to the gate voltage and the data voltage.

2. The display apparatus of claim 1, wherein the backlight unit comprises a plurality of light-emitting groups, and each of the light-emitting groups comprises a plurality of light-emitting diodes connected to each other in series.

3. The display apparatus of claim 2, wherein the backlight driving circuit comprises a plurality of channels connected to the light-emitting groups in one-to-one correspondence and is adapted to receive the feedback voltages through the channels.

4. The display apparatus of claim 3, wherein the backlight driving circuit is adapted to compare the feedback voltages with a predetermined reference voltage and control the boosting circuit according to the compared result to vary the backlight driving voltage.

5. The display apparatus of claim 4, wherein the boosting circuit is adapted to boost the backlight driving voltage until a feedback voltage having a lowest voltage level among the feedback voltages has a voltage level required by the panel driving circuit.

6. The display apparatus of claim 3, wherein the backlight driving circuit further comprises a compensating circuit connected to the channels to compensate a difference between the feedback voltages, and the compensated voltage by the compensating circuit is applied to the panel driving circuit as the panel driving voltage.

7. The display apparatus of claim 1, wherein the dimming signal is an analog dimming signal to control a size of driving current applied to the backlight unit.

8. The display apparatus of claim 7, further comprising, when the size of the driving current applied to the backlight unit is less than a predetermined reference current, a connection circuit is adapted to form a current path between an input of the backlight unit, to which the backlight driving voltage is input, and an output of the backlight driving circuit, from which the panel driving voltage is output.

9. The display apparatus of claim 8, wherein the connection circuit comprises:

a switching device turned on when the size of the driving current is less than the reference current;

a first resistor connected between an output electrode of the switching device and the output of the backlight driving circuit; and a second resistor connected between the output of the backlight driving circuit and ground.

10. The display apparatus of claim 1, further comprising a stabilization circuit comprising:

a zener diode connected between an output of the backlight driving circuit, from which the panel driving voltage is output, and ground to uniformly maintain the panel driving voltage; and a capacitor connected to the zener diode in parallel to remove a ripple of the panel driving voltage.

11. A display apparatus comprising:

a boosting circuit adapted to boost an input voltage to a backlight driving voltage;

a backlight unit adapted to receive the backlight driving voltage to generate a light;

a backlight driving circuit adapted to control the boosting circuit in response to a dimming signal;

a panel driving circuit adapted to receive a voltage feedback from the backlight unit to generate a gray-scale voltage, to output a data voltage corresponding to an image signal based on the gray-scale voltage, and to receive a gate driving voltage to generate a gate voltage; and a display panel adapted to display an image in response to the gate voltage and the data voltage.

12. The display apparatus of claim 11, wherein the backlight unit comprises a plurality of groups connected to each other in parallel, and each of the groups comprises a plurality of light emitting diodes connected to each other in series.

13. The display apparatus of claim 12, wherein the backlight driving circuit comprises a channel commonly connected to the groups and is adapted to receive the feedback voltage through the channel.

14. The display apparatus of claim 13, wherein the backlight driving circuit is adapted to compare the feedback voltage with a predetermined reference voltage and control the boosting circuit according to the compared result to vary the backlight driving voltage.

15. The display apparatus of claim 14, wherein the boosting circuit is adapted to boost the backlight driving voltage until the feedback voltage has a voltage level required by the panel driving circuit.

16. The display apparatus of claim 11, wherein the dimming signal is an analog dimming signal that controls a size of a driving current applied to the backlight unit.

17. The display apparatus of claim 16, further comprising, when the size of the driving current applied to the backlight unit is less than a predetermined reference current, a connection circuit adapted to form a current path between an input of the backlight unit, to which the backlight driving voltage is input, and a feedback of the backlight unit.

18. The display apparatus of claim 17, wherein the connection circuit comprises:

a switching device turned on when the size of the driving current is less than the reference current;

a first resistor connected between an output electrode of the switching device and the feedback of the backlight unit; and a second resistor connected between the feedback of the backlight unit and ground.

19. The display apparatus of claim 11, further comprising a stabilization circuit comprising:

a zener diode connected between a feedback of the backlight unit and ground to uniformly maintain the feedback voltage; and a capacitor connected to the zener diode in parallel to remove a ripple of the feedback voltage.

* * * * *